US005487082A

United States Patent [19]

Takenouchi et al.

[11] Patent Number: 5,487,082

[45] Date of Patent: Jan. 23, 1996

[54] ELECTRODE FOR ELECTROSLAG REMELTING AND PROCESS OF PRODUCING ALLOY USING THE SAME

[75] Inventors: Tomoo Takenouchi; Yoshiaki Ichinomiya; Junji Ishizaka, all of Hokkaido; Junji Itagaki, Tokyo; Shuzo Ohhashi, Hokkaido; Tsukasa Azuma, Hokkaido; Yasuhiko Tanaka, Hokkaido, all of Japan

[73] Assignee: The Japan Steel Works, Ltd., Tokyo, Japan

[21] Appl. No.: 243,736

[22] Filed: May 17, 1994

Related U.S. Application Data

[62] Division of Ser. No. 73,465, Jun. 9, 1993.

[30] Foreign Application Priority Data

| | | | |
|---|---|---|---|
| Jun. 11, 1992 | [JP] | Japan | 4-175976 |
| Jul. 31, 1992 | [JP] | Japan | 4-223642 |
| Aug. 14, 1992 | [JP] | Japan | 4-237607 |
| Oct. 21, 1992 | [JP] | Japan | 4-305876 |
| Oct. 22, 1992 | [JP] | Japan | 4-308054 |
| Nov. 20, 1992 | [JP] | Japan | 4-333753 |
| Jan. 21, 1993 | [JP] | Japan | 5-24974 |

[51] Int. Cl.[6] ..... H05B 3/60

[52] U.S. Cl. ..... 373/42; 373/54; 416/241 B; 29/889.2; 384/280

[58] Field of Search ..... 373/42, 47, 54, 373/79–82; 29/889.2, 458, 530; 228/208, 231; 416/198 A, 241 B, 219 R; 75/10.23; 148/526; 384/280, 276, 287, 290

[56] References Cited

U.S. PATENT DOCUMENTS

| | | | |
|---|---|---|---|
| 2,262,887 | 11/1941 | Deppeler | 373/54 |
| 2,591,709 | 4/1952 | Lubatti | 373/54 |
| 3,595,976 | 7/1971 | Wahlster et al. | 13/12 |
| 3,848,657 | 11/1974 | Tetjuev et al. | 164/252 |
| 3,929,523 | 12/1975 | Kinoshi et al. | 148/526 |
| 3,975,577 | 8/1976 | Ramacciotti et al. | 373/54 |
| 4,146,077 | 3/1979 | Klein et al. | 164/4 |
| 4,510,659 | 4/1985 | Okazaki | 29/156.8 R |
| 4,566,810 | 1/1986 | Yoshioka et al. | 384/280 |
| 4,581,816 | 4/1986 | Klufas et al. | 29/705 |
| 4,601,087 | 7/1986 | Kawai et al. | 29/157.1 R |
| 4,710,103 | 12/1987 | Faber et al. | 416/219 R |
| 4,743,165 | 5/1988 | Ulrich | 416/198 A |
| 4,778,345 | 10/1988 | Ito et al. | 416/241 B |
| 4,844,747 | 7/1989 | Jachowski et al. | 148/2 |
| 4,962,586 | 10/1990 | Clark et al. | 29/889.2 |
| 5,283,032 | 2/1994 | Wannes et al. | 420/586 |

*Primary Examiner*—Tu Hoang
*Attorney, Agent, or Firm*—Sughrue, Mion, Zinn, Macpeak & Seas

[57] ABSTRACT

A process for producing a turbine rotor using an ingot in which segregation is prevented effectively when ESR is used to produce a large-sized ingot. A hole is formed along an axial direction in the core of an electrode. The molten pool is made shallow and flat and segregation is prevented from occurring. Consequently, an ESR ingot of good quality offering an excellent surface is obtainable as it is free from segregation. Moreover, an electrode melting rate is increased and efficiency is improved so that a high quality turbine can be manufactured from the ingot.

8 Claims, 3 Drawing Sheets

| ELECTRODES | | INTERNAL DIAMETER/ EXTERAL DIAMETER | FILL RATIO |
|---|---|---|---|
| A | HOLLOW ELECTRODE | 0.74 | 0.73 |
| B | | 0.65 | 0.62 |
| C | | 0.44 | 0.54 |
| D | | 0.30 | 0.51 |
| E | SOLID ELECTRODE | 0 | 0.49 |

ELECTRODE FOR ELECTROSLAG REMELTING AND PROCESS OF PRODUCING ALLOY USING THE SAME

This is a divisional of application Ser. No. 08/073,465 filed Jun. 9, 1993.

BACKGROUND OF THE INVENTION

1. Field of the Invention

The present invention relates to a hollow electrode for use in electroslag remelting and a process of producing an alloy using the same, more specifically, relates to a process of producing a retaining ring material made of non-magnetic radical iron alloy and used for a turbine generator, relates to a semi-high-speed steel working roll for use in cold rolling, relates to a process of producing a hot-rolling forged-steel working roll material which is used for steel rolling and is excellent in heat, impact and crack resistant properties, and is wear resistant, relates to a process of producing a radical Ni - Fe heat resistant alloy ingot by means of electroslag remelting, relates to a process of producing a radical iron heat resistant alloy for use in a gas turbine and a superconductive generator member and relates to a process of producing high pressure-low pressure single cylinder turbine rotor for use as a turbine rotor shaft of a generator.

2. Prior Art

In order to increase productivity, not only the adoption of large-scale production facilities but also the enforcement of rigid operating conditions is in progress in power generation, chemical, iron and steel industries and so forth. It is now common that forged materials for use in those facilities are produced from ESR ingots through the electroslag remelting method (hereinafter called "ESR method") so as to ensure safety operation.

The ESR method is intended to obtain ingots having a smooth surface and good internal properties by remelting an electrode with joule heat resulting from supplying power from the solid electrode, causing the molten electrode to drop on a slag, and directionally solidifying the molten metal pool in a mold. In order to obtain such an ingot of good quality, it is necessary to supervise the molten metal pool while keeping the slag temperature at a suitable level. In other words, the determination of the ESR conditions is dependent on factors in such as electrode feed velocity, voltage, current, the depth of a slag bath, slag composition, a fill ratio (electrode diameter/mold diameter) and the like.

Since carbon or low alloy steel is relatively less sensitive to macro freckle or streak segregation, the segregation poses only a few problems when a small ingot is produced excluding a case where a large one is produced. On the other hand, high alloy containing a large amount of elements such as Ni, Cr, Mn and the like, otherwise radical Ni or Co super alloy is highly sensitive to segregation. Consequently, segregation occurs even when a relative small ingot is produced and this poses still another problem in that products exhibiting good performance are not manufactured.

Problems described above are caused in following examples.

A retaining ring material made of non-magnetic iron radical alloy and used for a turbine generator is often produced from an ESR ingot through the electroslag remelting method in the attempt to improve its internal properties.

The retaining ring material intended for the present invention is what has been standardized and known as ASTM A289 Classes B, C. Since such a material contains a large amount of Mn and Cr, even the ESR method is employed and even the aforesaid factors are controlled, macro freckle or streak segregation tends to appear in an ingot. Consequently, there arise cases where products exhibiting satisfactory performance are unavailable.

Recently, cold-rolling working rolls for actual use increasingly need to meet severe quality requirements as attempts are being made to increase efficiency of the rolling process. In order for such a working roll to bear continuous severe heavy-load, high-speed operating conditions, it is important to improve its fail-safe and wear resistant properties. Attention has also-been directed to cold-rolling working roll material of semi-high-speed steel highly resistant to wear and injury resulting from rolling, the material containing a carbide forming element other than Cr and causing a harder carbide to be separated out. As this semi-high-speed steel working roll material has a strong tendency for segregation, a special melting method called an electroslag remelting method has been employed to reduce the segregation.

The most important factor by which the soundness of the use layer of a semi-high-speed roll is impaired results from the appearance of streak segregation (inverted V segregation). If such segregation appears in a position close to the surface, the effective use diameter of a roll to be manufactured is narrowed. Moreover, difficulties in view of roll production is maximized as the risk of destruction at the time of hardening increases.

However, the problem is that though ESR is applied to the manufacture of the roll while the aforesaid factor is put under control, it is still difficult to evade the streak segregation sufficiently when the segregation tendency is great in view of composition. In other words, the small effective diameter for use is inferior in profitability.

Further, radical Ni - Fe heat resistant alloy (represented by Inconel (trade name) 718 and 706 alloys) ingots may normally be obtained through the electroslag remelting method so as to improve their internal properties. The ESR method is effectively utilized-particularly for large-sized ingots to prevent segregation.

Heat resistant alloy like radical Ni - Fe alloy is high sensitive to segregation as it contains a large amount of alloy elements. Even when a relatively small ingot which generally hardly generates segregation as compared with a large one is produced, the ESR method is applied thereto and adequate control is exerted as previously noted. Notwithstanding, macro freckle or streak segregation tends to appear on the ESR ingot and this still poses a problem in that products exhibiting good performance remain unavailable.

Moreover, the ESR ingot of Inconel alloy 718 among radical Ni - Fe heat resistant alloys has a poor surface and tends to cause forging fracture. For this reason, the surface of the ingot is machined to smooth it before being forged. However, another problem of deteriorating hot-rolling workability due to removal of the shell arises as the dense layer in the surface of the ingot is removed. In addition, there arises still another problem of lowering the ingot yielding rate as the high-quality portion of the ingot is not utilizable.

Radical iron heat resistant alloys as indicated by the standard Nos. JIS G4311~4312 SUH660, which offer high-temperature strength and excellent wear resistance, are used for gas turbine and jet engine members. As such alloys are capable of further offering greater strength, excellent toughness and stable non-magnetic properties at cryogenic temperatures, they are also used for superconductive generator members.

The material needs to meet severe user requirements and to provide greater durability in the fields of uses as previously noted. The mechanical properties of the radical iron alloy is also largely affected by the presence of a brittle deposit phase or a nonmetal inclusion. Consequently, a melt-refining process is required to minimize impurities in addition to make alloy design adequate. A special melting method called an electroslag remelting method has been employed for the purpose.

The most important factor by which the soundness of the quality of a SUH660 radical iron alloy is impaired results from the appearance of streak segregation and the segregation increases in percentage as the diameter of an ingot increases. However, the radical iron alloy is highly sensitive to segregation as it contains a large amount of alloy elements and even though ESR is applied to the manufacture of the ingot while the aforesaid factor is put under control during the ESR operation, it is still difficult to evade the macro segregation sufficiently.

As one of the turbines of generators, a high pressure-low pressure single cylinder turbine incorporating the high-pressure portion up to the low-pressure portion is well known and a high pressure-low pressure single cylinder turbine rotor is used for such a turbine.

The turbine rotor is usually exposed to high-temperature, high- and low-pressure steam and consequently material forming the rotor should be provided with not only satisfactory high-temperature creep strength but also excellent low-temperature toughness. However, only one kind of material can hardly satisfy these requirements and a high pressure-low pressure single cylinder turbine rotor of the sort that has been proposed so far is made to suit the operating conditions in a manner that the portion corresponding to high-medium pressure is made of Cr - Mo - V steel offering good high-temperature creep properties, whereas what corresponds to low pressure is made of Ni - Cr - Mo - V steel also offering excellent low-temperature toughness. There may be various methods of manufacturing such a composite turbine rotor but industrially the electroslag remelting method is considered most suitable. In this respect, Japanese Examined Patent Applications No. 4254/1977 and No. 14842/1981, Japanese Unexamined Patent Publication No. 23367/1981, No. 105502/1982 and No. 135536/1985 disclose processes of manufacturing such a composite turbine rotor.

If, however, materials are melted to manufacture a composite turbine rotor through the ESR method, a wide transition area would be formed between portions different in composition as different ingredients on both sides mix well and this poses a problem in that desired properties are unavailable. Notwithstanding, it still remains industrially unfeasible to produce composite turbine rotors through the ESR method.

SUMMARY OF THE INVENTION

An object of the present invention that has been made with the situation described above is to provide an ESR electrode for making it possible to obtain a less-segregated ingot by shallowing a molten metal pool even when a large-sized ESR ingot is produced.

Another object of the present invention is to provide a process of producing a retaining ring material offering excellent performance by reducing segregation of an ESR ingot.

Another object of the present invention is to provide a process of producing a semi-high-speed steel cold-rolling working roll offering a large diameter by effectively reducing the appearance of streak segregation on an ESR ingot.

Another object of the present invention made to solve the foregoing problems is to provide a process of producing an ESR ingot of hot-rolling forged-steel working material less segregated.

Another object of the present invention is to provide a process of producing an ingot free from segregation and having a satisfactory surface even when a radical Ni - Fe heat resistant alloy having a tendency for segregation is produced.

Another object of the present invention is to provide a process of producing an ingot free from segregation and having a satisfactory surface even when a large-sized radical iron alloy ingot.

An object of the present invention is to provide a process of industrially producing a composite turbine rotor of good quality through the ESR method while preventing a transition area from widening. An object of the present invention, there is provided a process of producing a high-medium pressure-low pressure single cylinder turbine rotor having pressure portions made of an ingot essentially consisting of chemical composition along with an environment condition from a high pressure portion to a low pressure portion, respectively, said process including a hollow electrode made of an ingot corresponding to said chemical composition of said pressure portions to melt a high pressure-low pressure single cylinder ingot by electroslag remelting.

According to first aspect of the present invention, there is provided a hole formed along an axial direction in the core of an ESR electrode.

According to the first aspect of the present invention, there is provided that an electrode has a sectional are of a hollow portion thereof accounting for 0.04~0.9 of the total sectional area of the electrode including the hollow portion.

According to the first aspect of the present invention, there is provided a cylindrical hollow electrode whose internal diameter accounts for 0.2~0.95 of its external diameter and whose external diameter accounts for 0.4~0.95 of the internal diameter of a mold.

According to the first aspect of the present invention, there is provided electroslag remelting performed by using the electrode to produce an alloy.

With the ESR electrode according to the present invention, its composition is not particularly restricted but determined by the intended alloy (ingot); however, the electrode is fit for use in manufacturing the ESR ingot of a sort that causes segregation to arouse a question. The electrode is fit for use in manufacturing, for example, carbon or low alloy steel ingots having a diameter of 800 mm or greater and containing 5% or less alloy elements other than iron, high alloy steel ingots having a diameter of 600 mm or greater and containing alloy elements ranging from 5% up to 50%, and super alloy ingots having a diameter of 350 mm or greater and containing 50% or greater of the total alloy element or the like.

It is therefore imperative to form a shallow disk-like molten metal pool so as to produce an ESR ingot having excellent internal properties free from macro segregation. If the pool is deep, the solidification structure tends to become rough as the structure is hindered from being made fine and macro segregation such as an inverted V segregation tends to occur. However, it is still difficult to make the pool shallow to the extent that the macro segregation is prevented from occurring while a good surface is maintained as the ingot grows larger than a marginal size.

When it is taken into consideration how the ESR electrode configuration is affected, for instance, the pool tends to become deep as the calorific value in the central portion of the molten slag is great at a small fill ratio and this allows a greater amount of current to flow through the coagulated ingot, thus causing the generation of joule heat to increase. On the other hand, the pool tends to become shallow as the whole molten slag generates heat at a large fill ratio and this decrease the percentage of current flowing through the ingot. However, it is still hardly feasible to make the pool satisfactorily shallow to the extent that no segregation occurs even in the latter case where the fill ratio is set greater.

According to the present invention, the current flowing through the ingot decreases from the position right under the center of the electrode and the depth of the molten pool in the central portion becomes shallow and this not only makes the pool flat but also suppresses the segregation. Moreover, the amount of power supplied to the vicinity of the mold increases to raise the slag temperature so that the surface of the ingot may be smoothed.

The process of producing an electrode according to the present invention is not particularly restrictive: it includes the steps of, for example, melting, refining and lumping metal in the atmosphere or in a vacuum depending on the desired gas and impurity components so as to make a hollow ingot; boring a hole in a solid ingot; bending planar ingot and joining both ends by welding; or assembling parts of a hollow ingot by welding. The electrode thus produced may be formed into a prism or any other deformed figure in addition to a cylinder. Although the hole bored in the electrode is normally situated in the center thereof, it need not be so located in the strict sense of the word but may be substantially formed in its core.

Moreover, the hole is not restrictive in shape and normally has a section similar to that of the outer wall of the electrode. For example, a circular hole is made in a cylindrical electrode and a square hole in a prism electrode. The hole is usually bored through the electrode but not restrictive to this example and one or both ends of the electrode may be closed up in a manner that the solid portion is melted at the initial or final stage of the ESR operation. Although the hole is normally bored along an axial direction in such a form as to have the same sectional area straight therethrough, it may have a deformed section depending on the axial position, for example, it may have a tapered inner shape along the axial direction. One hole is usually bored in the core of the electrode; however, more than one hole may be made therein.

The hole thus formed should preferably account for 0.04 ~0.9 of the total sectional area of the inside of the outer wall of an electrode. In the case of a circular hole of a cylindrical electrode, the diameter of the hole should preferably account for 0.2~0.95 of the external diameter of the electrode.

If the percentage above is less than the lower limit, the variation of the shape of the molten metal pool will be less affected and the effect of rendering the molten pool sufficiently flat will not be recognized. If the percentage exceeds the upper limit, on the other hand, the length of an electrode fit for obtaining the required weight of an ingot tends to increase and this makes it difficult to apply the percentage to actual operations. Therefore, 0.04~0.9 has been defined as a proper range in terms of sectional area percentage, and 0.2–0.95 in terms of diameter percentage.

Further, the external diameter of the electrode should preferably account for 0.4~0.95 of the internal diameter of a mold.

If the percentage is less than 0.4, the length of an electrode may be increased in order to obtain a desired weight of an ingot. Therefore, this condition is not suitable for applying a practical use. If the percentage exceeds 0.95, on the other hand, the space between the mold and the electrode is narrowed. While the ingot or the electrode is moved vertically, the former may come in contact with the latter. Namely, this condition is also not suitable for applying the practical use. Therefore, 0.4~0.95 has been defined as a desired range.

In addition to the use of one electrode according to the present invention, it is also possible to arrange a plurality of hollow electrodes on the circumference under the ESR method when, for example, hollow ESR ingots are produced. In this case, the effect characteristic of the hollow electrode is achievable too.

According to a second aspect of the present invention, there is provided a process of producing a retaining ring material containing C: 0.4~0.6%; Mn: 16~20%; Si: 0.8% or less; Cr: 3.5~6%; N: 0.2% or less by weight; Fe and inevitable impurities as the remnant, wherein a hollow electrode with a hole formed along an axial direction is used in the core of the electrode to implement electroslag remelting.

According to third aspect of the present invention, there is provided a process of producing a retaining ring material containing C: 0.13% or less; Mn: 17.5~20%; Si: 0.8% or less; Cr: 17.5~20%; N: 0.45~1% by weight; Fe and inevitable impurities as the remnant wherein a hollow electrode with a hole formed along an axial direction is used in the core of the electrode to implement electroslag remelting.

According to the second and third aspect of the present invention, the sectional area of the hollow portion of the electrode should accounts for 0.04~0.9 of the total sectional area of the electrode including the hollow portion.

Further, the electrode is a cylindrical hollow electrode whose internal diameter accounts for 0.2–0.95 of its external diameter and whose external diameter accounts for 0.4~0.95 of the internal diameter of a mold.

According to the second and third aspects of the present invention, in view of the material about the pool, a hollow electrode is employed when an ESR ingot of 18Mn - 5Cr or 18Mn - 18Cr retaining ring material having a tendency for segregation is produced. As a result, current flowing through the ingot from right below the center of the electrode decreases, thus causing a molten pool as a whole in the central portion to become not only shallow but also flat. In this way, an ESR ingot which is free from macro segregation and has excellent internal properties is obtainable. Moreover, the supplied amount of power also increases in the vicinity of the mold, thus making the surface of the ingot satisfactory as the slag temperature rises.

According to fourth aspect of the present invention, there is provided a process of producing a cold-rolling working roll containing C: 0.8~1.5%; Si: 1.5% or less; Mn: 1.5% or less; Cr: 2~6%; Mo: 0.7~2%; further one or two kinds of V: 0.2% or less and W: 2% or less by weight; Fe and inevitable impurities as the remnant, wherein a hollow electrode with a hole formed along an axial direction in the core of the electrode to implement electroslag remelting.

Of the inevitable impurities, Si: 0.1% or less; Mn: 0.1% or less; P: 0.005% or less; and S: 0.005% or less should preferably be contained.

According to the fourth aspect of the present invention, the sectional area of the hollow portion of the electrode accounts for 0.04~0.9 of the total sectional area of the electrode including the hollow portion.

According to another aspect of the present invention, the electrode is a cylindrical hollow electrode whose internal diameter accounts for 0.2–0.95 of its external diameter and whose external diameter accounts for 0.4~0.95 of the internal diameter of a mold.

The semi-high-speed cold-rolling working roll material according to the fourth aspect of the present invention is made to contain more than one kind of V: 2% or less and W: 2% or less in addition to C: 1~1.5%; Cr: 2~6%; and Mo: 0.7~2% as a basis, so that it becomes a known roll material provided with many superior properties.

As this roll material has a strong tendency for segregation, it has heretofore failed to make available a satisfactory ESR ingot free from segregation through the conventional ESR method. It has been found effective to reduce the streak segregation by employing such a hollow electrode as what is defined by the present invention.

In view of the material described about the pool, according to the present invention, a hollow electrode is employed when a high-speed steel ESR ingot having a strong tendency for segregation is produced. As a result, current flowing through the ingot from right below the center of the electrode decreases, thus causing a molten pool as a whole in the central portion to become not only shallow but also flat. In this way, an ESR ingot which is free from macro segregation and has excellent internal properties is obtainable. Moreover, the supplied amount of power also increases in the vicinity of the mold, thus making the surface of the ingot satisfactory as the slag temperature rises.

According to fifth aspect of the present invention, a process of producing a hot-rolling forged-steel working roll material containing C: 1.4~2%; Si: 0.6% or less; Mn: 0.4~1%; Ni: 0.5% or less; Cr: 2~3%; Mo: 0.7~1.2%; V: 4~7%; W: 1% or less by weight; Fe and inevitable impurities as the remnant, and having a chemical composition satisfying the following relational expression:

$$0.7<\{(\%C)+(\%Cr)\}/(\%V)<1$$

where, %c represents percentage of C by weight, %Cr represents percentage of Cr by weight and %V represents percentage of V by weight, wherein a hollow electrode is used for implement electroslag remelting.

In this case, the hollow electrode having the sectional area of a hollow portion which accounts for 0.04~0.9 of the total sectional area of the electrode including the hollow portion should preferably be used to implement electroslag remelting.

Moreover, the electrode is a cylindrical hollow electrode whose internal diameter should preferably accounts for 0.2–0.95 of its external diameter and whose external diameter accounts for 0.4~0.95 of the internal diameter of a mold.

Another sixth aspect of the present invention, a process of producing a radical Ni - Fe heat resistant alloy is such that the alloy contains Ni: 39~55%; Cr: 14.5~21%; Al: 0.2~0.8%; Ti: 0.65~2%; Nb: 2.5~5.5%; B: 0.006% or less by weight; Fe and inevitable impurities as the remnant to implement electroslag remelting.

In this case, the process of producing a radical Ni - Fe heat resistant alloy ingot should preferably use a hollow electrode having the sectional area of the hollow portion of the electrode accounting for 0.04~0.9 of the total sectional area of the electrode including the hollow portion. The process of producing a radical Ni - Fe heat resistant alloy ingot should preferably use a hollow electrode, which is a cylindrical hollow electrode whose internal diameter accounts for 0.2–0.95 of its external diameter and whose external diameter accounts for 0.4~0.95 of the internal diameter of a mold.

The ESR electrode according to the present invention is selected from a category of radical Ni - Fe heat resistant alloys, depending on the object and use, and its composition is not limited to any specific one.

According to seventh aspect of the present invention, there is provided a process of producing a radical iron heat resistant alloy containing Ni: 24~27%; Cr: 13.5~16%; Mo: 1.0~1.5%; Ti: 1.9~2.35%; C: 0.08% or less; Si: 1% or less; Mn: 2% or less; V: 0.1~0.5%; Al: 0.35% or less by weight; Fe and inevitable impurities as the remnant wherein a hollow electrode with a hole formed along an axial direction is used in the core of the electrode to implement electroslag remelting.

According to the seventh aspect the present invention, a process of producing a radical iron heat resistant alloy employing a hollow electrode whose sectional area accounts for 0.04~0.9 of the total sectional area of the electrode including the hollow portion to implement electroslag remelting.

According to the seventh aspect of the present invention, a process of producing a radical iron heat resistant alloy is characterized by using a cylindrical hollow electrode whose internal diameter accounts for 0.2–0.95 of its external diameter and whose external diameter accounts for 0.4~0.95 of the internal diameter of a mold.

When a SUH660 radical iron alloy is produced, the conventional ESR method has been found difficult to obtain a sound ESR ingot free from segregation. The present invention therefore employs a hollow electrode instead of a solid one heretofore in use to reduce macro segregation.

According to eighth aspect of the present invention, a process of producing a high pressure-low pressure single cylinder turbine rotor having pressure portions different in chemical composition along with an environment condition from a high pressure portion to a low pressure portion, respectively, comprises the steps of using a hollow electrode having different chemical compositions axially corresponding to those of the above portions and melting a rotor material by electroslag remelting.

According to the eighth aspect of the present invention, a process of producing a high pressure-low pressure single cylinder turbine rotor further comprises the steps of subjecting to deviation or uniform heat treatment the respective high-medium- and low-pressure portions of a turbine rotor proper in the environment of operating a steam turbine when the turbine rotor proper made of rotor material obtained by electroslag remelting is heat-treated, quenching the respective portions that have been subjected to deviation or uniform cooling treatment, and tempering the respective portions more than once.

The turbine rotor needs not necessarily include each of the high-medium- and low-pressure portions and it may include at least more than one portion according to which it may have more than one portion different in composition.

With respect to chemical ingredients, decision to be made may depend on the properties required for the operating environment. For example, a portion corresponding to the high-medium-pressure portion may be made of Cr - Mo - V steel offering satisfactory high-temperature creep strength, whereas what corresponds to the low-pressure portion may be made of Ni - Cr - Mo - V steel offering excellent low-temperature toughness.

The composition will subsequently be shown by way of example: a portion corresponding to the high-medium pressure may be made of Cr - Mo - V steel containing C: 0.20~0.35%; Si: 0.3% or less; Mn: 1.0% or less; Ni: 2.5% or less; Cr: 0.5~2.5%; Mo: 0.5~2.0%; V: 0.15~0.4% by weight; Fe and inevitable impurities as the remnant, and a portion corresponding to the low pressure may be made of Ni - Cr - Mo - V steel containing C: 0.20~0.35%; Si: 0.1% or less; Mn: 1.0% or less; Ni: 2.5%~4.0%; Cr: 1.0~3.0%; Mo: 0.2~1.0%; V: 0.05~0.20% by weight; Fe and inevitable impurities as the remnant. In the case of the Cr - Mo - V steel, it may further contain at least more than one of the following elements as desired: Nb: 0.1% or less; Ta: 0.1% or less; and W: 2% or less.

The ESR electrode axially different in composition may be prepared by combining ingots different in composition or continuously using electrodes different in composition during the ESR operation.

According to the eighth aspect of the present invention, the electrode has a sectional area of a hollow portion thereof accounting for 0.04~0.9 of the total sectional area of the electrode including the hollow portion.

According to the eighth aspect the present invention, a cylindrical hollow electrode whose internal diameter accounts for 0.2–0.95 of its external diameter and whose external diameter accounts for 0.4~0.95 of the internal diameter of a mold.

The heating and cooling treatments in the present invention are such that their ranges are selected in accordance with the composition in each portion of the turbine rotor.

Either differential heat or cooling treatment may selectively be adopted at the time of quenching and combined with the uniform heat or cooling treatment. However, the quenching in combination with the differential heat and cooling treatments is more preferable.

As a cooling method which is able to effect a cooling rate higher than what is available from oil-cooling may be an oil-, water- or water-spray-cooling method. As a cooling method capable of effecting a cooling rate lower than what is available from breeze-cooling and air-cooling, for instance may be employed.

When the conventional ESR method is used to manufacture such a high pressure-low pressure single cylinder turbine rotor, it has a wide transition area formed between portions different in composition as different ingredients on both sides mix well. If, however, a hollow electrode is used to produce the high pressure-low pressure single cylinder turbine rotor, current flowing through the ingot from right below the center of the electrode decreases, thus causing a molten pool in the central portion to become not only shallow but also flat. As a result, the transition area extending over molten sections having different ingredients can be minimized.

Moreover, the Cr - Mo - V steel is used to form what corresponds to the high-medium-pressure portion of the turbine rotor and the Ni - Cr - Mo - V steel to form what corresponds to the low-pressure portion, whereby the former exhibits satisfactory high-temperature creep strength and the latter offers excellent low-temperature toughness.

In addition, the adoption of differential heat or cooling treatment at the time the turbine rotor proper is quenched makes it possible to quench the area having different ingredients under optimum conditions in accordance with the composition desired, thus making feasible the introduction of desired properties into the rotor.

DETAILED DESCRIPTION OF THE PREFERRED EMBODIMENTS

Preferred embodiments of the present invention will be now described in reference with accompanying drawings.

EXAMPLE 1

A material whose specification satisfies JIS S25C was melted under the normal method to manufacture cylindrical electrodes having a circular hole made in the center by means of a core. Four kinds of electrodes A~D having different internal/external diameter ratios as shown in Table 1 were prepared according to the present invention. In addition, a comparative solid electrode E was also prepared through the conventional method without using a core. These electrodes were made to conform ESR conditions so that they had the substantially same sectional area (excluding the hole) and that the same melting rate was made obtainable.

Figure 1:
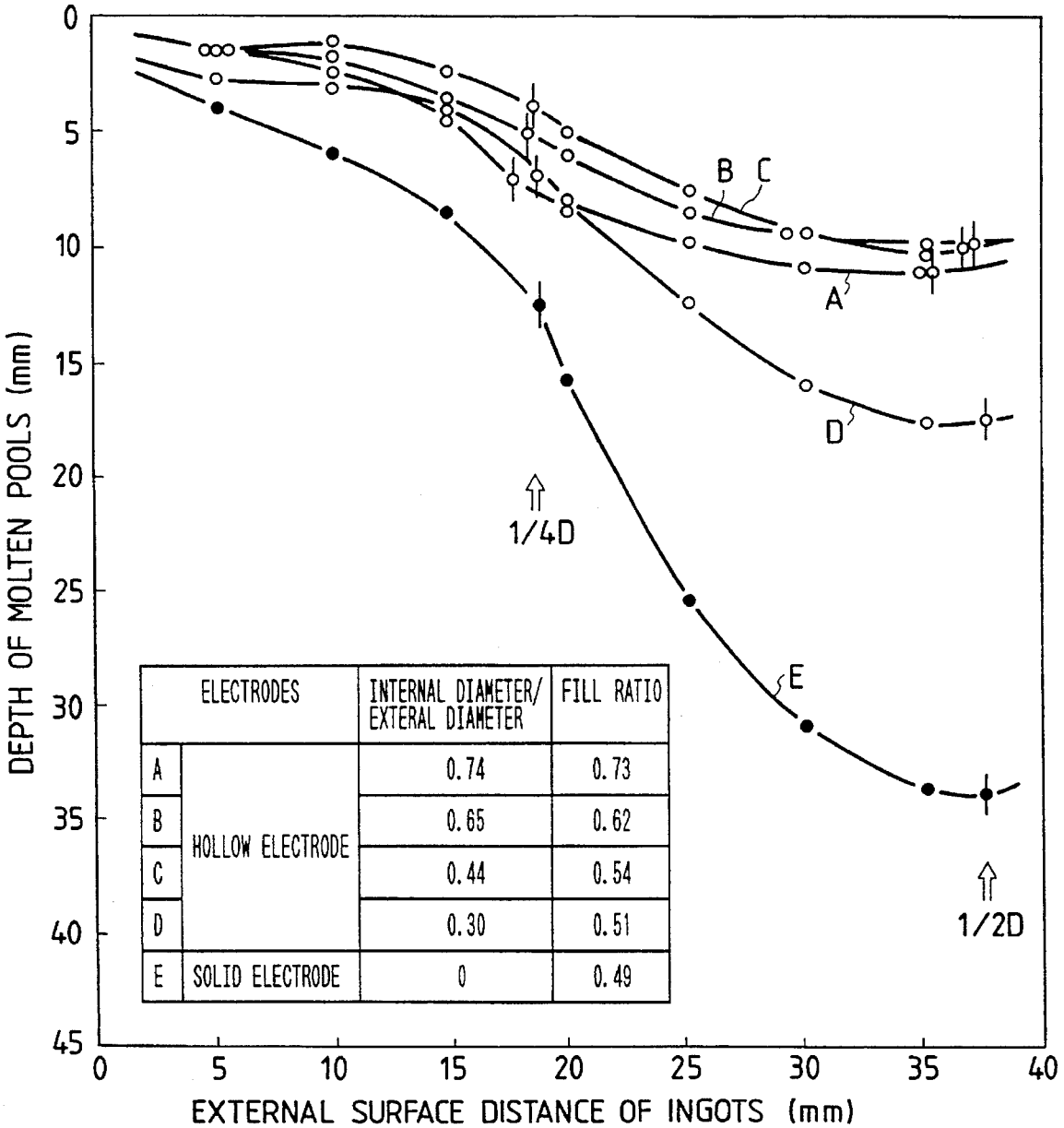
FIG. 1 is a graph showing the relation between the external surface distance of ingots and the depth of molten pools in Example 1.

ESR was implemented by using those ESR electrodes and 50%$CAF_2$ - 20%CaO - 30%$Al_2O_3$ (wt%) slag in molds having a diameter of 80 mm at a melting rate of 260 g/min. Fe - S was added to a molten pool 15 minutes after the start of ESR to obtain a sulfur print so as to measure the depth of the molten pool. FIG. 1 is a graph showing the relation between the depths of the molten pools and distances from the outer surfaces of ingots. As is obvious from FIG. 1, cases where ESR was implemented using the hollow electrodes showed that each molten pool was not only shallow but also flat. On the other hand, the pool in the central portion was found very deep when ESR was implemented with the conventional solid electrode.

TABLE 1

| Electrodes | | External diameter (mm) | Internal diameter (mm) | Internal diameter/ external diameter | External diameter of electrode/ internal diameter of mold |
|---|---|---|---|---|---|
| Hollow electrodes | A | 58.0 | 43.0 | 0.74 | 0.73 |
| | B | 49.5 | 32.0 | 0.65 | 0.62 |
| | C | 43.0 | 19.0 | 0.44 | 0.54 |
| | D | 40.5 | 12.0 | 0.30 | 0.51 |
| Solid electrode | E | 39.0 | — | — | 0.49 |

EXAMPLE 2

Figure 2:
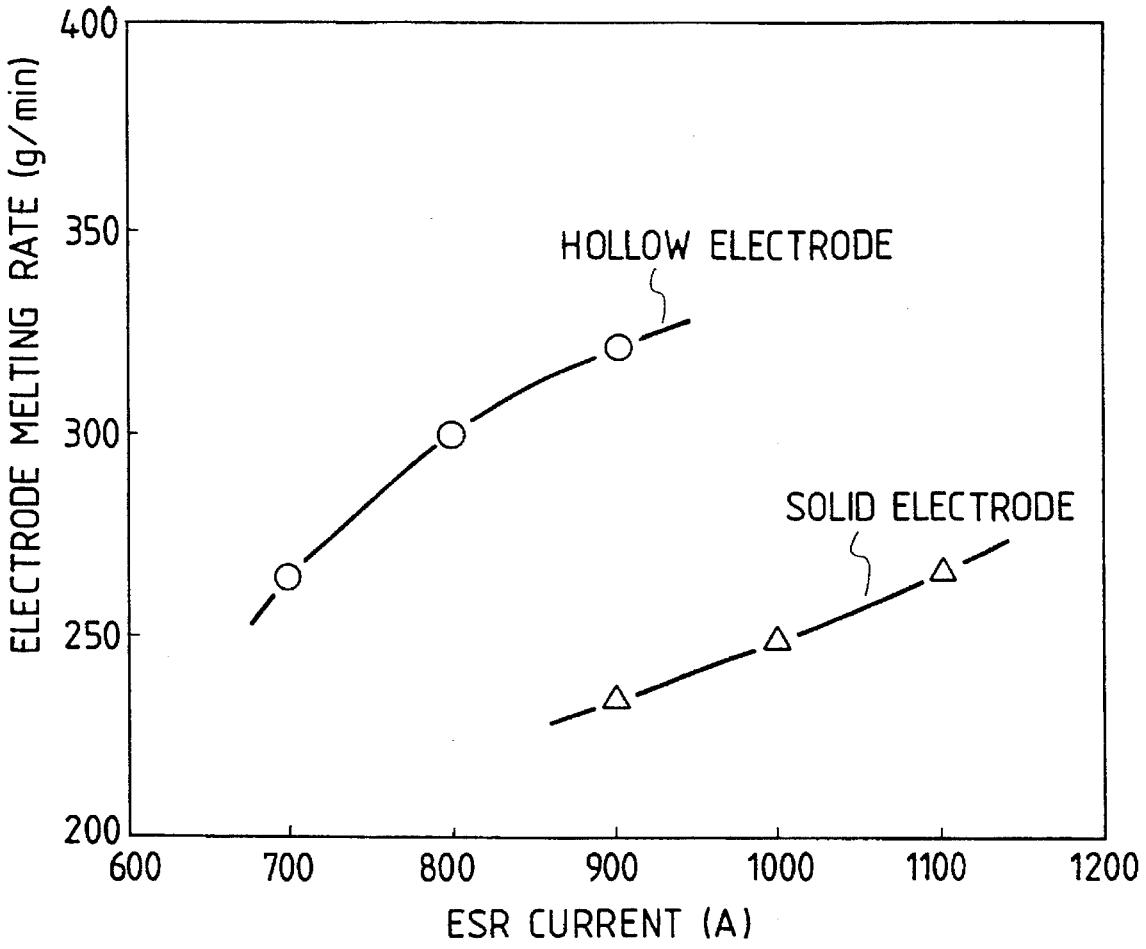
FIG. 2 is a graph showing the relation between ESR current and electrode melting rates in Example 2.

The electrode A employed in the example 1 of the invention and the comparative electrode E were used for measuring their melting rates by varying the ESR current under mold-slag conditions similar to those in the example 1. FIG. 2 shows the results obtained. The electrode according to the present invention allowed to make the melting rate higher than that of the comparative electrode at the same ESR current. Consequently, the use of the hollow electrode according to the present invention was seen to have the effect of reducing the ESR power consumption as the melting rate is made extremely higher. This seems to result from the fact that the contact area between the electrode and the slag has increased.

EXAMPLE 3

Subsequently, six kinds of alloys suitable for the application of the present invention thereto were chosen. In this case, an electric furnace was used to melt low and high alloy steel and a ladle refining furnace (VOD furnace) was used to vacuum-smelt the steel. Further, the molten steel was poured downwardly so as to produce solid or hollow electrodes. In the case of super alloy, material was melted in a vacuum melting furnace to produce fragmentary cast electrodes and then solid and hollow electrodes by welding. At the time the aforesaid electrodes were produced, a plurality of electrodes having different configurations were produced before being subjected to ESR. Melting rates were simultaneously measured. The ESR ingots thus obtained were formed into round bars at a forging ratio of 4 and subsequently macro segregation was evaluated on the basis of macro corrosion. The surface of each ingot was also evaluated. Table 2 shows the results obtained.

As shown in Table 2, the surfaces of some ingots of low and high alloy steel appeared fine and slightly poor when the solid electrodes were used. With respect to the internal properties, trifling macro segregation was observed in every case. In the case of super alloy, the surfaces of ingots appeared slightly poor and conspicuous macro segregation was observed.

On the contrary, the surfaces of ingots and the internal properties both became remarkably improved when the hollow electrodes were used, so that ESR ingots of good quality were obtained.

TABLE 2

| Alloys | Configuration of electrode (diameter/mm) | | Ingot diameter (diameter/mm) | Melting rate (kg/min) | Surface of ingot | Macro segregation |
|---|---|---|---|---|---|---|
| Low alloy steel (NiCrMoV steel) | 680 | Solid | 1000 | 12.5 | ○ | Δ |
| | External diameter 800<br>Internal diameter 420 | Hollow | 1000 | 12.2 | • | • |
| High alloy steel (12Cr steel) | 680 | Solid | 1000 | 11.8 | ○ | Δ |
| | External diameter 800<br>Internal diameter 420 | Hollow | 1000 | 12.0 | ○ | • |
| High alloy steel (A 286 steel) | 540 | Solid | 800 | 8.8 | Δ | Δ |
| | External diameter 700<br>Internal diameter 440 | Hollow | 800 | 8.6○ | • | |
| High alloy steel (18Mn18Cr) steel) | 680 | Solid | 1000 | 11.2 | ○ | Δ |
| | External diameter 800<br>Internal diameter 420 | Hollow | 1000 | 10.9 | • | • |
| Super alloy (Inconel 718) | 320 | Solid | 450 | 5.7 | Δ | x |
| | External diameter 370<br>Internal diameter 185 | Hollow | 450 | 5.8 | ○ | • |
| | External diameter 700<br>Internal diameter 440 | Hollow | 800 | 6.7 | ○ | ○ |
| Super alloy (Inconel 706) | 450 | Solid | 600 | 6.7 | Δ | x |
| | External diameter 500<br>Internal diameter 220 | Hollow | 600 | 6.8 | ○ | • |
| | External diameter 700<br>Internal diameter 440 | Hollow | 800 | 7.1 | ○ | ○ |

(Inconel is a registered trade name)
Surface of ingot/macro segregation:
• = very good, ○ = good, Δ = slightly poor, x = poor

EXAMPLE 4

Figure 3:
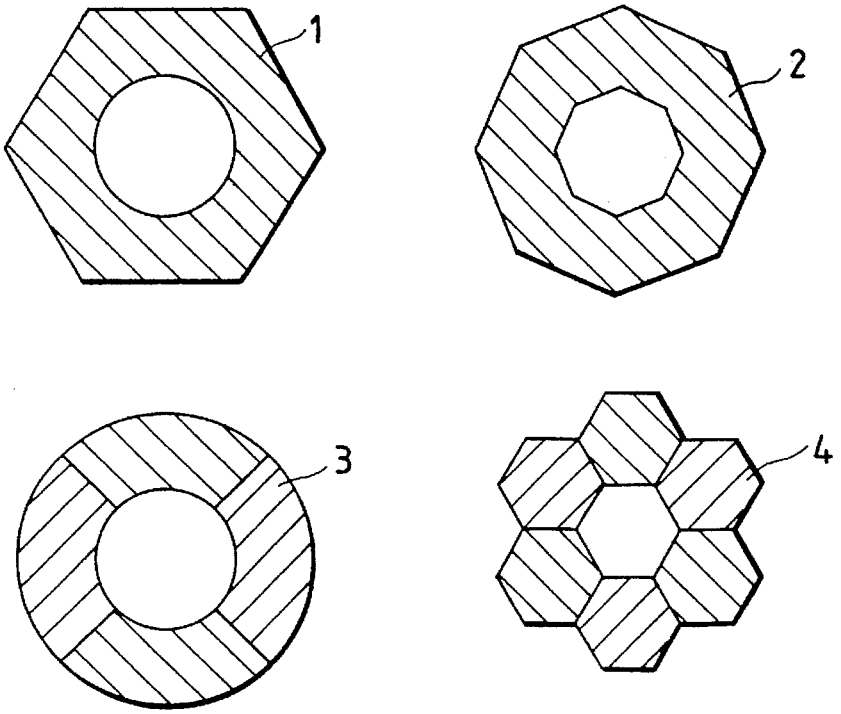
FIG. 3 is transverse sectional views of electrodes having modified configurations according to the present invention.
Figure 4:
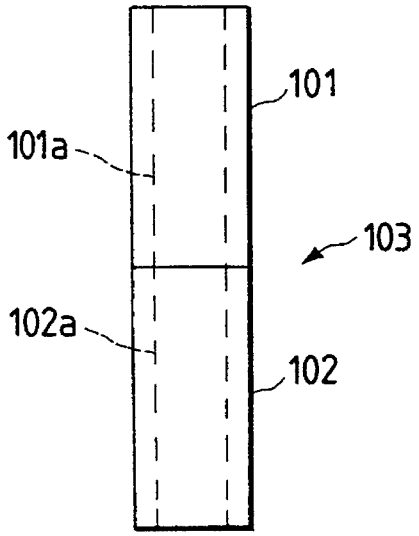
FIG. 4 is an elevational view of a hollow electrode embodying Example 11 of the present invention.

Although a description has been given of cylindrical electrodes with the circular hole formed therein in the examples 1~3, electrodes and types of holes are not limited to those shown by way of example. FIG. 3 illustrates, for instance, a prism electrode 1, segmented electrodes 2, 3 and 4.

EXAMPLE 5

Retaining ring material according to the present invention as shown in Table 3 was melted under the normal method to manufacture cylindrical electrodes having a circular hole made in the center by means of a core. Four kinds of electrodes A~D having different internal/external diameter ratios as shown in Table 4 were prepared according to the present invention. In addition, comparative solid electrodes E, F were also prepared through the conventional method without using a core. These electrodes were made to conform ESR conditions so that they had the substantially same sectional area (excluding the hole) and that the same melting rate was made obtainable.

ESR was implemented by using those ESR electrodes and slag in a mold 1000 mm in diameter.

The ESR ingot thus obtained was formed into a disk and subsequently macro segregation was evaluated on the basis of macro corrosion. The surface of each ingot was also evaluated. Table 5 shows the results obtained.

As shown in Table 5, the surfaces of some ingots appeared fine and slightly poor when the conventional solid electrodes were used. With respect to the internal properties, macro segregation was observed in every case. On the contrary, the surfaces of ingots and the internal properties both became remarkably improved when the hollow electrodes were used, so that ESR ingots of good quality were obtained.

TABLE 3

| Steels | Electrode chemical composition (wt %) | | | | | | | |
|---|---|---|---|---|---|---|---|---|
| | C | Mn | Si | Cr | N | P | S | Fe |
| 18Mn-5Cr | 0.51 | 18.3 | 0.51 | 4.98 | 0.12 | 0.030 | 0.004 | rest |
| 18Mn-18Cr | 0.08 | 19.2 | 0.48 | 19.8 | 0.68 | 0.032 | 0.003 | rest |

TABLE 4

| Electrodes | | External diameter (mm) | Internal diameter (mm) | Internal diameter/ external diameter | External diameter of electrode/ internal diameter of mold | Steels |
|---|---|---|---|---|---|---|
| Hollow | A | 900 | 590 | 0.66 | 0.90 | 18Mn-5Cr |
| electrodes | B | 800 | 420 | 0.53 | 0.80 | " |
| | C | 900 | 590 | 0.66 | 0.90 | 18Mn-18Cr |
| | D | 800 | 420 | 0.53 | 0.80 | " |
| Solid | E | 680 | — | — | 0.68 | 18Mn-5Cr |
| electrode | F | 680 | — | — | 0.68 | 18Mn-18Cr |

TABLE 5

| Electrodes | | Surface of ingot | Macro segregation | Steels |
|---|---|---|---|---|
| Hollow | A | ⊙ | ⊙ | 18Mn-5Cr |
| electrodes | B | ⊙ | ⊙ | " |
| | C | ⊙ | ⊙ | 18Mn-18Cr |
| | D | ⊙ | ⊙ | " |
| Solid | E | Δ | Δ | 18Mn-5Cr |
| electrodes | F | x | Δ | 18Mn-18Cr |

Surface of ingot/macro segregation:
⊙ = very good, o = good, Δ = slightly poor, x = poor

EXAMPLE 6

The electrodes A and C employed in the example 5 of the invention and the comparative electrodes E and F were used to measure their melting rates by varying the ESR current under mold-slag conditions similar to those in the example 1. The electrodes according to the present invention allowed to make the melting rate higher than that of the comparative electrodes at the same ESR current. Consequently, the use of the hollow electrode according to the present invention was seen to have the effect of reducing the ESR power consumption as the melting rate is made extremely higher. This seems to result from the fact that the contact area between the electrode and the slag has increased.

EXAMPLE 7

Although a description has been given of cylindrical electrodes with the circular hole formed therein in the examples 5, 6, electrodes and types of holes are not limited to those shown by way of example. FIG. 3 illustrates, for instance, a prism electrode 1, segmented electrodes 2, 3 and 4.

As set for the above, the application of the ESR method to 18Mn - 5Cr or 18Mn - 18Cr retaining ring material together with the adoption of the hollow electrode according to the embodiments described above makes the molten pool shallow and flat, thus suppressing the formation of segregation. Thus an ESR ingot having excellent internal properties and a smooth surface can be produced, whereby a high performance retaining ring material is obtainable.

EXAMPLE 8

Specimen steel having a composition of Table 6 was melted under the normal method to manufacture cylindrical electrodes having a circular hole made in the center by means of a core. Four kinds of electrodes A~D having different internal/external diameter ratios as shown in Table 7 were prepared according to the present invention. In addition, a comparative solid electrode E was also prepared through the conventional method without using a core. These electrodes were made to conform ESR conditions so that they had the substantially same sectional area (excluding the hole) and that the same melting rate was made obtainable.

ESR was implemented by using those ESR electrodes and 50%CAF2 - 20%CAO - 30%Al2O3 (wt%) slag in molds having a diameter of 800 mm at a melting rate of 750 kg/hr.

The transverse sections of the ESR ingots thus obtained were subjected to macro corrosion so as to observe the degree to which streak segregation was formed and to evaluate the surfaces thereof.

As shown in Table 8, the surface of the ingot was poor and had internal properties causing streak segregation to be formed at a position as shallow as 68 mm from the surface when the conventional solid electrode was used. On the contrary, the formation of streak segregation occurred at a position of 164 mm or greater from the surface and the internal properties became remarkably improved when the hollow electrodes were used, so that ESR ingots of good quality were obtained.

TABLE 6

| Roll material composition (wt %) | | | | | | | | | |
|---|---|---|---|---|---|---|---|---|---|
| C | Si | Mn | Cr | Mo | P | S | V | W | Fe |
| 1.2 | 0.45 | 0.65 | 3.70 | 1.20 | 0.005 | 0.0025 | 1.64 | 0.79 | rest |

TABLE 7

| Electrodes | | External diameter (mm) | Internal diameter (mm) | Internal diameter/ external diameter | External diameter of electrode/ internal diameter of mold |
|---|---|---|---|---|---|
| Hollow electrodes | A | 560 | 212 | 0.38 | 0.70 |
| | B | 600 | 300 | 0.50 | 0.75 |
| | C | 640 | 375 | 0.59 | 0.80 |
| | D | 680 | 440 | 0.65 | 0.85 |
| Solid electrode | E | 520 | — | — | 0.65 |

TABLE 8

| Electrodes | | Depth of streak segregation (mm) | Surface of ingot |
|---|---|---|---|
| Hollow electrodes | A | 123 | ○ |
| | B | 140 | ○ |
| | C | 157 | ◎ |
| | D | 164 | ◎ |
| Solid electrode | E | 68 | x |

Surface of ingot:
◎ = very good, ○ = good, x = poor of alloy elements, it has a strong tendency for segregation and consequently ESR ingots prepared through the electroslag remelting method are employed in view of preventing segregation.

Since the hot-rolling forged-steel working material intended for the present invention contains a large amount of alloy elements, macro freckle or streak segregation tends to easily appear even though the ESR method is applied thereto and products offering satisfactory performance remain unavailable.

Example 9 is to provide a process of producing an ESR ingot of hot-rolling forged-steel working material less segregated.

First, 15~20 tons of ingots having a composition of Table 9 were melted under the normal method to manufacture a cylindrical electrode having a circular hole in the center by means of a core. Four kinds of electrodes A~D having different internal/external diameter ratios as shown in Table 10 were prepared according to the present invention. In addition, a comparative solid electrode E was also prepared through the conventional method without using a core. These electrodes were made to conform ESR conditions so that they had the substantially same sectional area (excluding the hole) and that the same melting rate was made obtainable.

TABLE 9

| Chemical composition (wt %) | | | | | | | | | |
|---|---|---|---|---|---|---|---|---|---|
| C | Si | Mn | Ni | Cr | Mo | V | W | Co | {(% C) + (% Cr)}/(% V) |
| 1.90 | 0.42 | 0.64 | 0.33 | 2.93 | 0.98 | 5.13 | 0.32 | 0.38 | 0.94 |

TABLE 10

| Electrodes | | External diameter (mm) | Internal diameter (mm) | Internal diameter/ external diameter | External diameter of electrode/ internal diameter of mold |
|---|---|---|---|---|---|
| Hollow electrodes | A | 850 | 550 | 0.65 | 0.85 |
| | B | 800 | 470 | 0.59 | 0.80 |
| | C | 750 | 380 | 0.51 | 0.70 |
| | D | 700 | 270 | 0.39 | 0.70 |
| Solid electrode | E | 640 | — | — | 0.64 |

As set forth above, the use of the hollow electrode according to the example of the present invention makes the molten pool shallow and flat when the semi-high-speed steel cold-rolling working roll is manufactured through the ESR method. Moreover, the streak segregation formed on the ESR ingot is driven into the ingot with the effect of increasing its effective diameter for use.

EXAMPLE 9

On the other hand, in order to secure heat, impact and crack resistant properties and wear resistance, a high-speed steel roll material containing a large amount of composite C, Cr, Mo, V, W is used for the hot-rolling forged-steel working material as disclosed in Japanese Patent Application No. 206212/1992. As this roll material contains a large amount ESR was implemented by using those ESR electrodes in molds having a diameter of 1000 mm at a melting rate of 750 kg/hr.

The ESR ingots thus obtained were formed into round bars at a forging ratio of 4 and subsequently macro segregation was evaluated on the basis of macro corrosion. The surface of each ingot was also evaluated. Table 11 shows the results obtained.

As shown in Table 11, the surfaces of some ingots appeared poor when the solid electrodes were used. With respect to the internal properties, trifling macro segregation was observed in every case. On the contrary, the surfaces of ingots and the internal properties both became remarkably improved when the hollow electrodes were used, so that ESR ingots of good quality were obtained.

TABLE 11

| Electrodes | Surface of ingot | Macro segregation |
|---|---|---|
| A | ⊙ | ⊙ |
| B | ○ | ⊙ |
| C | ○ | ○ |
| D | ○ | ○ |
| E | x | x |

Surface of ingot/macro segregation:
⊙ = very good, ○ = good, x = poor

A detailed description will subsequently be given of the reason for restricting chemical ingredients of the roll material according to Example 9.

C: 1.4~2%

C not only gives the material hardness but also improves wear resistance by forming a carbide. Therefore, the amount of C to be solidified in the roll material and what is used to form the carbide should be appropriate. In order to give the roll material a desired shore hardness of 75 or greater, depending on the heat treatment condition, the material needs to contain at least 1.4% C. On the other hand, deep thermal impact cracks would be produced if the material is allowed to contain C of more than 2% as it greatly promotes the formation of a net-like eutectic carbide in the coagulation intergranular field. If a large amount of eutectic carbide is produced, hot-rolling workability would be deteriorated and this would make difficult the stable production of rolls. Therefore, the C-content has been limited to 1.4~2%.

Si: 0.6% or less

Although Si effectively acts as a deoxidizer, its content should be minimized in view of reducing the tendency for segregation. As far as the material according to the present invention is concerned, Si-content has been limited to 0.6% or less as the sound layer depth (free from segregation) of the surface layer of the roll hardly becomes securable. Consequently, the Si-content has been limited to 0.6% or less.

Mn: 0.4~1%

Mn acts as what improves hardenability. If Mn-content is 0.4% or less, its effect would not be apparent, whereas if the Mn-content exceeds 1%, the material would become brittle. Therefore, the Mn-content has been limited to 0.4~1%.

Ni: 0.5% or less

Although Ni acts as what improves hardenability and mechanical properties of the material, a large amount of remaining austenite is produced at the time of quenching if Ni-content exceeds 0.5% and the hardenability is reduced. Therefore, the Ni-content has been limited to 0.5% or less.

Cr: 2~3%

Cr acts as what improves hardenability, mechanical properties and wear resistance of the material by forming a carbine. However, it also greatly promotes the formation of a net-like eutectic carbide in the coagulation intergranular field. If Cr-content exceeds 3%, a deep thermal impact crack would be produced. Moreover, the wear resistance is less affected by Cr and in view of wear resistance, it is unnecessary to add a large amount of Cr exceeding, for example, 3% to the material. On the other hand, Cr that has solidified in the material acts as what improve the heat, impact and crack resistance. In order to effect the action, the material should contain Cr of 2% or more.

Therefore, the Cr-content has been limited to 2~3%.

Mo: 0.7~1.2%

Mo assumes an important role of securing a hardened surface layer necessary for a roll material so as to improve its hardenability and temper softening resistance. Moreover, Mo acts as what forms a carbide, thus improving wear resistance. When Mo-content is 0.7% or less, its effect remains indistinct, whereas when it exceeds 1.2%, the upper limit temperature at the time of hot rolling is lowered and forgeability is also lowered.

Therefore, the Mo-content has been limited to 0.7~1.2%.

V: 4~7%

V forms an extremely hard carbide which effectively contributes to improving wear resistance. While the V carbide is used to secure high wear resistance, excellent heat, impact and crack resistance is provided by optimizing the form of the carbide. In other words, the form of the eutectic carbide is greatly affected by V and the eutectic cell in which the V-carbide has been dispersed in the coagulated grains is formed as the nucleus of the carbide on condition that the V-content is balanced with C and Cr in a certain relationship and the development of large-sized rough eutectic carbide in a net-like form decreases. In such a composition which makes the adequate balance available, excellent heat, impact and crack resistance is obtainable as the net-like large-sized rough eutectic carbide decreases.

The V-content of 4% or more should be contained so as to further decrease the depth of the heat and impact crack thus produced. If the V-content of more than 7% is contained, on the other hand, a good eutectic carbide is obtained in view of its form. However, the amount of C fixed as the V-carbide increases as the amount is great and this makes it difficult to secure the amount of solidified C needed for hardness in the material at the quench-heating temperature. Further, the formation of segregation becomes conspicuous and the segregated portion with a mass of carbide tends to start cracking during the hot-rolling or quenching work, thus greatly deteriorating producibility.

Therefore, the V-content has been limited to 4~7%.

$0.7<\{(\%C)+(\%Cr)\}/(\%V)<1$

As previously noted, importance should be attached to the effective combination of Cr- and V-content so as to secure the necessary amount of solidified C, Cr in the material and to optimize the form of the eutectic carbide. In addition to the aforesaid reasons for limiting the content of each element in the roll material according to the present invention, excellent heat, impact and crack resistant properties are obtained by defining the above range of combinations at $0.7<\{(\%C)+(\%Cr)\}/(\%V)<1$. If the numerical value deviates from either upper or lower limit, the balance will be destroyed; consequently, no satisfactory heat, impact and crack resistant properties are obtainable.

W: 1% or less

W forms a hard carbide and also improves wear resistance. On the other hand, a large amount of W causes a net-like eutectic carbide to be produced in the coagulation intergranular field, thus deteriorating hot-rolling workability. Therefore, the W-content has been limited to 1% or less.

Co: 1% or less

Co is substantially solidified in the material and acts as what improves its hardenability and temper softening resistance with the effect of securing the hardness of a roll and improving heat, impact and crack resistant properties. On the other hand, hardenability would be deteriorated if Co is excessively contained. Therefore, the Co-content has been limited to 1% as an upper limit.

As set forth above, the process of producing a hot-rolling forged-steel working roll material according to Example 9 of the present invention is used to produce a high-speed steel roll material having specific ingredients through the ESR method using the hollow electrode, so that the roll material free from segregation and having a satisfactory surface. Together with excellent heat, impact and crack properties due to the specific ingredients, the present invention has the effect of producing the hot-rolling forged-steel working roll material of extremely good quality.

EXAMPLE 10

Radical Ni - Fe heat resistant alloys having a composition of Table 11 were melted under the normal method to manufacture cylindrical electrodes having a circular hole in the center by means of a core. Two kinds of electrodes having different internal/external diameter ratios as shown in Table 13 were prepared according to the present invention. In addition, a comparative solid electrode was also prepared through the conventional method without using a core. These electrodes were made to conform ESR conditions so that they had the substantially same sectional area (excluding the hole) and that the same melting rate was made obtainable.

TABLE 12

| Alloy | Chemical composition (wt %) | | | | | | | | |
|---|---|---|---|---|---|---|---|---|---|
| No. | Ni | Cr | Mo | Al | Ti | Nb | B | Fe | Remarks |
| 1 | 42.5 | 16.0 | — | 0.35 | 1.78 | 3.05 | 0.002 | rest | Inconel 706 alloy |
| 2 | 51.2 | 18.1 | 2.95 | 0.60 | 0.95 | 5.10 | 0.002 | rest | Inconel 718 alloy |

TABLE 13

| Alloy | Electrode configuration (diameter/mm) | | Ingot diameter (diameter/mm) | Melting rate (kg/min) | Surface of ingot | Macro segregation | Remarks |
|---|---|---|---|---|---|---|---|
| 1 | 450 | Solid | 600 | 6.7 | Δ | x | Comparative |
| | External diameter 500 Internal diameter 220 | Hollow | 600 | 6.8 | o | ⊙ | Invention |
| | External diameter 700 Internal diameter 440 | Hollow | 800 | 7.1 | o | o | |
| 2 | 320 | Solid | 450 | 5.7 | Δ | x | Comparative |
| | External diameter 370 Internal diameter 185 | Hollow | 450 | 5.8 | o | ⊙ | Invention |
| | External diameter 700 Internal diameter 440 | Hollow | 800 | 6.7 | o | o | |

Surface of ingot/macro segregation:
⊙ = very good, o = good, Δ = slightly poor, x = poor ESR was implemented by using those ESR electrodes in molds at the melting rate shown in Table 13.

The ESR ingots thus obtained were formed into round bars and subsequently the edge faces at both ends were subjected to macro corrosion so as to evaluate macro segregation. Table 13 shows the results obtained.

As shown in Table 13, the surfaces of some ingots appeared poor when the solid electrodes were used. With respect to the internal properties, trifling macro segregation was observed in every case. On the contrary, the surfaces of ingots, even though they were large-sized, and the internal properties both became remarkably improved when the hollow electrodes were used, so that ESR ingots of good quality were obtained.

As set forth above, the hollow electrode is used to produce the ESR ingot so as to make the molten pool shallow and flat while segregation is prevented from occurring. As a result, even the radical Ni - Fe heat resistant alloy having a strong tendency for segregation is made free therefrom with the effect of making available an ingot of good quality having a satisfactory surface.

EXAMPLE 11

Specimen alloy having a composition of Table 14 was melted under the normal method to manufacture cylindrical electrodes having a circular hole made in the center by means of a core. Three kinds of electrodes A~C having different internal/external diameter ratios as shown in Table 15 were prepared according to the present invention. In addition, a comparative solid electrode D was also prepared through the conventional method without using a core. These electrodes were made to conform ESR conditions so that they had the substantially same sectional area (excluding the hole) and that the same melting rate was made obtainable.

ESR was implemented by using those ESR electrodes and 50%$CAF_2$ - 15%CaO - 25%$Al_2O_3$ - 10%$TiO_2$ (wt%) slag in molds having a diameter of 1000 mm at a melting rate of 600 kg/hr.

The transverse sections of the ESR ingots thus obtained were subjected to macro corrosion so as to observe the degree to which streak segregation was formed and to evaluate the surfaces thereof.

As shown in Table 16, the surface of the ingot was poor and had internal properties exhibiting a number of streak segregation when the conventional solid electrode was used. On the contrary, the hollow electrodes B and C were completely free from macro segregation, though minimal segregation was observed in the case of the hollow electrode A. The surface of the ingot became greatly improved and ESR ingots of good quality were obtained.

Although a description has been given of cylindrical electrodes with the circular hole formed therein in the example above, electrodes and types of holes are not limited to those shown by way of example. FIG. 3 illustrates, for instance, prism electrodes 1, 2, segmented electrodes 3, 4.

TABLE 14

| Radical iron heat resistant alloy composition (wt %) | | | | | | | | |
|---|---|---|---|---|---|---|---|---|
| Si | Mn | Ni | Cr | Mo | Ti | Al | V | Fe |
| 0.06 | 1.19 | 24.92 | 14.91 | 1.36 | 2.15 | 0.20 | 0.24 | Rest |

TABLE 15

| Electrodes | | External diameter (mm) | Internal diameter (mm) | Internal diameter/ external diameter | External diameter of electrode/ internal diameter of mold |
|---|---|---|---|---|---|
| Hollow electrodes | A | 700 | 200 | 0.29 | 0.70 |
| | B | 750 | 330 | 0.44 | 0.75 |
| | C | 800 | 430 | 0.54 | 0.80 |
| Solid electrode | D | 670 | — | — | 0.67 |

TABLE 16

| Electrodes | | Presence or absence of streak segregation | Surface of ingot |
|---|---|---|---|
| Hollow electrodes | A | Minimum | Δ |
| | B | Nil | ○ |
| | C | Nil | ◎ |
| Solid electrode | D | Many | x |

Surface of ingot:
◎ = very good; ○ = good; Δ = slightly poor; x = poor.

As set forth above, the use of the hollow electrode according to Example 11 of the present invention makes the molten pool shallow and flat when the radical iron heat resistant alloy is produced through the ESR method. Moreover, the streak macro segregation formed on the ESR ingot is prevented with the effect of improving the surface of the ingot.

EXAMPLE 12

Cr - Mo - V steel and Ni - Cr - Mo - V steel having compositions of Table 17 were melted under the normal method to manufacture cylindrical electrodes respectively having circular central holes 101*a*, 102*a* made by means of a core. These electrodes 101, 102 were combined by welding to form an electrode 103. Four kinds of electrodes having different internal/external diameter ratios as shown in Table 18 were prepared according to the present invention. In addition, a comparative electrode was also prepared by combining solid electrodes having the composition above through the conventional method without using a core. These electrodes were made to conform ESR conditions so that they had the substantially same sectional area (excluding the hole) and that the same melting rate was made obtainable.

After the start of ESR, Fe - S was added to a molten pool immediately before the electrode joint began to melt and a sulphur print thus obtained was used to measure the depth of the molten pool. In every example for implementing ESR using the hollow electrode according to the present invention, the molten pool was found shallow and flat. On the contrary, the pool in the central portion was very deep in the case of the conventional solid electrode used to implement ESR. This means that the ESR ingot obtained through the method according to the present invention was such that a transition area where both compositions mixed well was formed therebetween in a relatively narrow range. With the comparative example, on the other hand, different ingredients mixed over a wide range in the deep molten pool in operation, thus forming a greater transition area.

TABLE 17

| Portion for use | Chemical composition (wt %) | | | | | | | | | Remarks |
|---|---|---|---|---|---|---|---|---|---|---|
| | C | Si | Mn | Ni | Cr | Mo | V | P | S | |
| High–medium | 0.30 | 0.20 | 0.71 | 0.35 | 1.10 | 1.15 | 0.30 | 0.005 | 0.003 | Cr-Mo-V steel |
| Low | 0.25 | 0.04 | 0.35 | 3.60 | 1.75 | 0.40 | 0.11 | 0.005 | 0.003 | Ni-Cr-Mo-V steel |

TABLE 18

| Electrodes | | External diameter (mm) | Internal diameter (mm) | Internal diameter/ external diameter | External diameter of electrode/ internal diameter of mold |
|---|---|---|---|---|---|
| Hollow electrodes | A | 58.0 | 43.0 | 0.74 | 0.73 |
| | B | 49.5 | 32.0 | 0.65 | 0.62 |
| | C | 43.0 | 19.0 | 0.44 | 0.54 |
| | D | 40.5 | 12.0 | 0.30 | 0.51 |
| Solid electrode | E | 39.0 | — | — | 0.49 |

Four ESR ingots thus obtained from the hollow electrodes A, B, C and D were heated at 1200° C. and forged by hot working at a forging ratio of 4 to manufacture-turbine rotors proper having a bodily diameter of 75 mm. The turbine rotor proper obtained had the high-medium-pressure portion made of Cr - Mo - V steel and the low-pressure portion made of Ni - Cr - Mo - V steel. The turbine rotor proper was also subjected to the following heat treatment after forging by hot working.

Under one of the methods according to the present invention, each turbine rotor proper was uniformly heated at 940° C. and the portion corresponding the high-medium-pressure portion was cooled at a cooling rate of 25° C./h on the assumption of a forced air-cooling rate in the central portion of an actual turbine rotor proper, whereas the portion corresponding to the low-pressure portion was cooled at a rate of 50° C./h on the assumption of a water-spray-cooling rate in the central portion thereof. The turbine rotor was thus quenched at the different cooling rates (uniform heating, differential cooling).

Under another method according to Example 11, the high-medium-pressure portion of the turbine rotor proper was heated at 970° C. and the low-pressure portion thereof at 900° C. Then these portions were cooled at a cooling rate of 50° C./h on the assumption of water-spray-cooling rate in the central portion thereof before being quenched (differential heating, uniform cooling).

Under still another method according to Example 11, the high-medium-pressure portion of the turbine rotor proper was heated at 970° C. and the low-pressure portion thereof at 900° C. Further, the high-medium-pressure portion was cooled at a cooling rate of 25° C./h on the assumption of a forced air-cooling rate in the central portion of an actual turbine rotor proper, whereas the low-pressure portion was cooled at a cooling rate of 50° C./h on the assumption of a water-spray-cooling rate in the central portion thereof before being quenched (differential heating, differential cooling).

For comparison, moreover, the turbine rotor proper was uniformly heated at 950° C. and then cooled at a cooling rate of 50° C./h on the assumption of a water-spray-cooling rate in the central portion of an actual turbine rotor proper before being quenched (uniform heating, uniform cooling).

In that case, the high- and low-pressure portions of each turbine rotor proper were tempered at 670° C. for 20 hours and 630° C. for 20 hours after being quenched, respectively.

Table 19 shows test results of specimen steels after heat treatment.

As is obvious from Table 19, the differential heating or cooling improved the high-temperature creep strength of the high-pressure portion and the toughness of the low-pressure portion as compared with the conventional method. Moreover, the differential heating-differential cooling method according to the present invention is found far superior to the uniform heating-differential cooling or differential heating-uniform cooling method in achieving the intended effect.

TABLE 19

| Classification | | Position | 0.2% yield strength (kgf/mm$^2$) | Tensile strength (kgf/mm$^2$) | Elongation (%) | Drawing (%) | Fracture surface transition temperature (°C.) | Creep fracture time (h) |
|---|---|---|---|---|---|---|---|---|
| Invention | Uniform heating differential cooling | Low-pressure portion | 75.2 | 88.3 | 22 | 73 | −8 | — |
| | | High-pressure portion | 67.2 | 83.3 | 22 | 61 | +73 | 253 |
| | Differential heating uniform cooling | Low-pressure portion | 71.3 | 84.2 | 22 | 73 | −45 | — |
| | | High-pressure portion | 68.5 | 84.7 | 22 | 62 | +90 | 425 |
| | Differential heating differential cooling | Low-pressure portion | 71.3 | 84.2 | 22 | 73 | −45 | — |
| | | High-pressure portion | 69.4 | 85.5 | 21 | 62 | +90 | 547 |
| Comparative method | Uniform heating uniform cooling | Low-pressure portion | 76.1 | 89.4 | 20 | 71 | +5 | — |
| | | High-pressure portion | 67.7 | 83.9 | 21 | 72 | +85 | 315 |

As set forth above, the hollow electrode is used to produce a composite turbine rotor through the ESR method. As a result, the process of producing a high pressure-low pressure single cylinder turbine rotor according to the present invention can largely reduce the transition area between portions having different ingredients so that the high pressure-low pressure single cylinder turbine rotor of excellent quality can be produced industrially.

Moreover, optimum properties depending on the composition are made available by quenching different ingredients at heating and cooling temperatures most suitable for them. Turbine rotors of superior quality can thus be obtained.

A description will subsequently be given of the desired heat treatment conditions to which the turbine rotor proper according to Example 12 is subjected.

Quenching heating temperature

Uniform heating: 900°~1000° C.

When the whole portion is uniformly heated, sufficient high-temperature creep strength is unavailable at an austenitizing temperature of 900° C. or lower and low-temperature toughness decreases at 1000° C. or higher. Therefore, the uniform heating temperature range has been limited to the above.

Differential heating: 900°~1030° C. for high-medium-pressure portion; 870°~1000° C. for low-pressure portion; (high~medium-pressure portion temperature - low-pressure portion temperature) 20°~80° C.

When the heating temperature is made different between the high-medium-pressure and low-pressure portions, satisfactory high-temperature creep strength is unavailable at an austenitizing temperature of 900° C. or lower and high-temperature notch repture ductility decreases at 1030° C. or higher. Therefore, the temperature range has been limited above. On the other hand, the low-temperature toughness decreases in the low-temperature portion at an austenitizing temperature of 870° C. or lower as the carbide is not completely solidified and the low-temperature toughness also decreases at an austenitizing temperature of 1000° C. or higher as the austenite grains tend to become large.

The austenitizing temperature in the high~medium-pressure portion is so selected that it is made higher by 20°~80° C. than that in the low-pressure portion. In order to secure the functional effect, however, the temperature difference should exceed 20° C. If the temperature difference exceeds 80° C., on the other hand, it will makes the manufacturing process unfeasible. Therefore, the temperature difference range has been limited above.

Cooling rate (in the case of differential cooling treatment)

A portion corresponding to the high·medium-pressure portion is quenched at a cooling rate lower than breeze-cooling so as to secure satisfactory high-temperature creep strength. If that portion is cooled at a rate exceeding the forced air-cooling, an amount of lower bainite composition increases, thus making sufficient high-temperature creep strength unavailable. Moreover, a portion corresponding to the low-temperature portion is quenched at a cooling rate higher than an oil-cooling so as to obtain good low-temperature toughness; if the portion is cooled at a cooling rate lower than the oil-cooling rate, the low-temperature toughness would be impaired as the composition comes to include ferrite or upper bainite.

Tempering temperature: 550°~700° C.

If the tempering temperature is lower than 550° C., no satisfactory tempering effect is obtained and so is toughness. If, on the other hand, the tempering temperature exceeds 700° C., desired strength is not available. Therefore, the temperature range has been limited above. In addition, the tempering temperatures of the high·medium-pressure and low-pressure portions can be set variable.

As set forth above, the ESR electrodes has the effect of making available ESR ingots of good quality free from segregation even when the present invention is applied to large-sized ingots and alloy steel sensitive to segregation since the molten pool is shallow and flat. Moreover, the use of the hollow electrode is also effective in increasing the melting rate, reducing power consumption and improving production efficiency.

What is claimed is:

1. A process of producing a high-medium and low pressure turbine rotor having high-medium and low pressure portions different in chemical compositions comprising the steps of a hollow electrode having different chemical compositions in an axial direction of said electrode corresponding to said chemical compositions of said high-medium and low pressure portions of said turbine rotor, melting the hollow electrode an electroslag in said axial direction to form a turbine rotor material corresponding to said chemical compositions of said high-medium and low pressure portions, and forming the turbine rotor out of the rotor material.

2. A process of producing a high pressure-low pressure turbine rotor as claimed in claim 1, further comprising:

subjecting at least one of said high-medium and low pressure portions to one of differential and uniform heat treatments in an environment with steam when the turbine rotor is heat-treated;

quenching said at least one of said high-medium and low pressure portions of the turbine rotor that have been subjected to said one of differential and uniform heat treatments in said environment with steam and thereby tempering said at least one of said high-medium and low pressure portions.

3. A process of producing a high pressure-low pressure turbine rotor as claimed in claim 1, wherein said high-medium pressure portion of said turbine rotor is made of CR - Mo - V steel containing C: 0.20 to 0.35%; Si: not more than 0.3%; Mn: not more than 1.0%; Ni: not more than 2.5%; Cr: 0.5 to 2.5%; Mo: 0.5 to 2.0%; V: 0.15 to 0.4% by weight; Fe and inevitable impurities, and a low pressure of said turbine rotor is made of Ni - Cr - Mo - V steel containing c: 0.20 to 0.35%; Si: not more than 0.1%; Mn: not more than 1.0%; Ni: 2.5% to 4.0%; Cr: 1.0 to 3.0%; Mo: 0.2 to 1.0%; V: 0.05 to 0.20% by weight; Fe and inevitable impurities.

4. A process of producing a high pressure-low pressure turbine rotor as claimed in claim 1 said Cr - Mo - V steel further contains at least more than one of the following elements as desired: Nb: not more than 0.1%; Ta: not more than 0.1%; and W: not more than 2%.

5. A process of producing a high medium and low pressure turbine rotor having pressure portions made of an ingot, said ingot essentially consisting of a chemical composition which varies along with said pressure portions of the rotor from a high-medium pressure portion to a low pressure portion of the rotor, respectively, said process comprising the steps of providing an electrode having a hole which is formed along an axial direction in a core of said electrode, said electrode being made of a material corresponding to said chemical composition, melting said electrode to form said ingot, and forming said turbine rotor from the material.

6. A process of producing a high pressure-low pressure turbine rotor as claimed in claim 5, further comprising:

subjecting at least one of said high-medium and low pressure portions to one of differential and uniform heat treatments in an environment with steam when the turbine rotor is heat-treated;

quenching at least one of said high-medium and low pressure portions that have been subjected to said one of differential and uniform heat treatments in said environment with steam and thereby tempering said at least one of said high-medium and low pressure portions.

7. A process of producing a high pressure-low pressure turbine rotor as claimed in claim 6, wherein said high·medium pressure portion of said turbine rotor is made of Cr - Mo - V steel containing C: 0.20~0.35%; Si: not more than 0.3%; Mn: not more than 1.0%; Ni: at least 2.5%; Cr: 0.5 to 2.5%; Mo: 0.5 to 2.0%; V: 0.15 to 0.4% by weight; Fe and inevitable impurities, and a low pressure portion of said turbine rotor is made of Ni - Cr - Mo - V steel containing C: 0.20 to 0.35%; Si: not more than 0.1%; Mn: not more than 1.0%; Ni: 2.5%; to 4.0%; Cr: 1.0~3.0%; Mo: 0.2 to 1.0%; V: 0.05 to 0.20% by weight; Fe and inevitable impurities.

8. A process of producing a high pressure-low pressure turbine rotor as claimed in claim 7, wherein said Cr - Mo - V steel further contains at least more than one of the following elements as desired: Nb: not more than 0.1%; Ta: not more than 0.1%; and W: not more than 2%.

* * * * *